US005985221A

United States Patent [19]

Knecht

[11] Patent Number: 5,985,221

[45] **Date of Patent: *Nov. 16, 1999**

[54] METHOD OF RECOVERING PRECIOUS METALS

[75] Inventor: Johann Knecht, Wadersloh, Germany

[73] Assignee: Krupp Polysius AG, Germany

[ * ] Notice: This patent issued on a continued prosecution application filed under 37 CFR 1.53(d), and is subject to the twenty year patent term provisions of 35 U.S.C. 154(a)(2).

[21] Appl. No.: 08/729,313

[22] Filed: Oct. 15, 1996

Related U.S. Application Data

[63] Continuation of application No. 08/366,496, Dec. 30, 1994, abandoned.

[30] Foreign Application Priority Data

Jan. 13, 1994 [DE] Germany ..... 44 00 796

[51] Int. Cl.[6] ..... C22B 11/00

[52] U.S. Cl. ..... 423/22; 423/27; 423/28; 423/29; 423/30; 423/31; 423/DIG. 15

[58] Field of Search ..... 423/27, 31, 29, 423/28, 30, DIG. 15, 22

[56] References Cited

U.S. PATENT DOCUMENTS

| | | | |
|---|---|---|---|
| 4,206,879 | 6/1980 | Geiger | 241/46.11 |
| 4,421,724 | 12/1983 | Hunnel | 423/31 |
| 4,512,879 | 4/1985 | Attia et al. | 209/3 |
| 4,557,905 | 12/1985 | Sherman et al. | 423/27 |
| 4,606,763 | 8/1986 | Weir | 423/27 |
| 4,670,051 | 6/1987 | Schneider | 423/27 |
| 4,721,526 | 1/1988 | Elmore et al. | 423/31 |
| 4,754,953 | 7/1988 | Brison et al. | 423/31 |
| 4,960,461 | 10/1990 | Esna-Ashari et al. | 423/27 |
| 5,110,056 | 5/1992 | Blasczyk et al. | 241/19 |
| 5,346,532 | 9/1994 | Sinclair et al. | 423/31 |
| 5,351,894 | 10/1994 | Longhurst et al. | 241/21 |
| 5,364,453 | 11/1994 | Kohr | 423/27 |

*Primary Examiner*—Steven Bos

*Attorney, Agent, or Firm*—Reising, Ethington, Barnes, Kisselle, Learman & McCulloch P.C.

[57] ABSTRACT

The invention relates to a method of recovering precious metals from oxidic or refractory or semi-refractory ore material containing precious metal. This recovery of precious metal takes place with optimal comminution work and with more efficient and more reliable leaching also of non-oxidic ore material in such a way that the ore material is subjected to material bed comminution in the grinding gap between two rollers which are pressed against one another under high pressure and revolve in opposite directions and afterwards the comminuted ore material is preferably leached using a stirring movement in a container.

15 Claims, 5 Drawing Sheets

METHOD OF RECOVERING PRECIOUS METALS

This application is a continuation of application Ser. No. 08/366,496 filed on Dec. 30, 1994, now abandoned.

BACKGROUND OF THE INVENTION

The invention relates to a method of recovering precious metals from ore material containing such metals.

In this specification the expression "ore material" is intended to include any corresponding naturally occurring ore or ore material, any residues in ore mining and also any industrial residues which contain precious metal. Moreover, the expression "precious metal" encompasses gold, silver and platinum.

For the recovery of precious metals it has long been known to use so-called "heap leaching", which is regarded as an economical method of recovering precious metals from oxidic precious metal ores. In this recovery of precious metals a type of pile or heap consisting of broken and ground ore particles, in which all ore particles are in close surface contact with neighbouring ore particles, is treated with a leaching agent or leaching fluid, such as for example a cyanide solution, which is intended to dissolve the contained precious metal. Before the ore is placed on the heap it is comminuted in order to reduce the particle size and to increase the surfaces of all the ore particles. The comminution is normally carried out in at least one comminution stage or zone or can also be carried out in a roller crushing arrangement, as is described in U.S. Pat. No. 4,960,461. After this, oxidic ore is comminuted in a high-pressure roller press, a binding agent having previously been added to it so that proportions of fine material from the comminution process can be bound to coarser particles in order to make the heap permeable to the leaching fluid. In this known method for this leaching the comminuted product coming out of the high-pressure roller press is delivered directly to the heap without further treatment.

In order to achieve the maximum efficiency for the recovery of precious metal in this heap leaching or in order to ensure the most economical recovery possible, the heap is normally very large and is exposed directly to the atmosphere. The leaching fluid is poured or sprayed directly onto the heap and penetrates the heap, so that it dissolves compounds containing precious metal with which it comes into contact. This charged leaching fluid is collected for further processing.

Such a heap leaching is used only for the treatment of oxidic ores and has not proved effective for the efficient recovery of precious metals from non-oxidic, refractory and semi-refractory precious metal ores.

Since the supply of directly leachable oxidic ores containing precious metal is becoming smaller, the commercial recovery of precious metals from semi-refractory and refractory ores is becoming increasingly important. Precious metal which is contained in non-oxidic ores is normally in the form of sulphides and natural precious metal, and/or it is completely encapsulated in an impermeable gangue matrix. Ores of this type normally require fine comminution (fine grinding) as well as a concentration of material and/or oxidative treatment in order to make them more accessible to leaching.

SUMMARY OF THE INVENTION

A preferred method of leaching oxidic refractory and semi-refractory ores containing precious metals and concentrates obtained therefrom consists of suspending the individual ore particles in a leaching fluid in such a way that the particles are kept in motion and are surrounded by the leaching fluid, and the leaching fluid should act to the greatest possible extent on the entire outer surface of the particles. For this the comminuted ore is treated in a closed container containing the leaching fluid.

For a cost-effective recovery of precious metals from oxidic, refractory and semi-refractory ores with the aid of container leaching the ore should be capable of being ground without the addition of a binding agent in such a way that a) the quantity of super-fine material which normally results from over-grinding is reduced to a minimum,
b) the largest possible surface area is created by inter-particle breaks,
c) the iron contamination is reduced or brought down to a minimum which results from abrasion of parts of the equipment, which markedly lowers the extraction of precious metal during the leaching process and increases the costs of reagents,
d) an agglomeration of finest particles on other particles of material for grinding is reduced to a minimum, which reduces the surface area accessible to the leaching fluid and has an unfavourable influence on the metal extraction,
e) flaking of metal particles exposed during grinding is eliminated or reduced to a minimum and a close binding of these exposed particles to other components of the ground ore is prevented,
f) and the time and the necessary grinding energy is reduced to a minimum in order to achieve the desired size distribution of the ground particles.

It is well known that the usual comminution and grinding equipment, such as for example ball mills, bar mills, hammer mills or the like as well as combinations thereof do not satisfactorily meet the above requirements and that these techniques prove very costly when they are used with oxidic, refractory and semi-refractory ores. Thus there is a need for a cost-effective method which can be carried out in practice for an efficient recovery of precious metals from ore materials containing such precious metals which cannot be subjected, or not directly, to the heap leaching mentioned above.

The object of the invention, therefore, is to provide a method which, with relatively low expenditure on equipment, with optimal comminution work and with markedly reduced energy consumption and costs, is distinguished over the aforementioned known methods by an extremely efficient and reliable leaching of ore material containing precious metal, i.e. both oxidic and non-oxidic refractory and/or non-refractory ore material, in which above all ore materials should be processed for which heap leaching is not or is not directly suitable for extraction of the precious metals.

According to a first aspect of the invention oxidic or refractory or semi-refractory ore material is subjected to material bed comminution in the grinding gap between two rollers which are pressed against one another under a high pressure and revolve in opposite directions to form a comminuting zone, whereupon in a subsequent method step the comminuted ore material is leached in a container forming a mixing zone using a stirring motion, at least the majority of the comminuted ore particles being separated from or kept out of contact with one another.

With this procedure it will then also be advantageous in the processing of non-oxidic starting ore material for the comminuted refractory and/or semi-refractory ore material also to be subjected to oxidation treatment before the container leaching.

According to a second aspect of the invention non-oxidic refractory and/or semi-refractory ore material is likewise subjected to material bed crushing at least in the grinding gap between two rollers which are pressed against one another under a high pressure and revolve in opposite directions, whereupon the comminuted ore material is then, however, subjected to oxidation in each case before the leaching. In this case the leaching of the oxidised ore material is then particularly preferably carried out in a mixing zone using a stirring movement in a container, at least the majority of the comminuted ore particles being kept out of contact with one another. However, as an alternative to this the oxidised ore material can also be generally subjected to heap leaching since this ore material which is comminuted—in material bed comminution—is first of all subjected to an intensive oxidation treatment before the leaching operation, so that certain ore materials which contain precious metals can be prepared in an advantageous manner so that afterwards they can be leached in a heap in the usual way.

As has already been indicated above, however, the aforementioned container leaching is generally preferred in this method according to the invention, because in this way oxidic or non-oxidic, refractory and/or semi-refractory ore materials containing precious metal can be broken up or leached particularly efficiently and with great reliability.

In this way, by contrast with the known methods mentioned in the introduction, a marked increase is achieved overall in the extraction of precious metals from the said ore materials. Furthermore the extraction costs in the preparation process are markedly reduced.

The comminution of the ore material in the form of a material bed comminution which is known per se constitutes an important method step in this invention. In this case in a so-called material bed roller mill the ore material is passed through the grinding gap between two rollers which are pressed against one another under high pressure (>50 MPa) and revolve in opposite directions and is simultaneously subjected to individual grain comminution and material bed comminution so that the size of the ore particles is reduced and at the same time internal microcracks and microfissures are produced in these ore particles. In this way the ore material to be processed is comminuted in the optimal manner so that the requirements listed above under a) to f) for the comminution necessary for the leaching operation are at least largely satisfied. For many types of starting ore materials this material bed comminution is already sufficient in order to be able to carry out the subsequent leaching operation efficiently and with great reliability and a high performance. In particular this material bed comminution contributes to a substantial extent to the fact that this recovery method can be carried out with relatively low expenditure on apparatus and with comparatively low energy requirement and with relatively low costs.

However, in the case of many starting ore materials, particularly in the case of ore material in relatively large pieces, it may be advantageous if it is subjected to primary comminution or primary crushing before the material bed comminution, so that the ore material can then be delivered at an optimal starting size to the material bed comminution.

With many ore materials it may also be advantageous, depending upon the physical properties, for it to be ground up further after the material bed comminution and before a possible oxidation treatment in a (further) fine comminution stage, i.e. this oxidation treatment takes place in the case of non-oxidic refractory or semi-refractory ore material, whereas in the case of oxidic ore material it can generally be omitted. An agitator mill or drum mill which is known per se can be used for this fine comminution stage. However, it is also possible to carry out a second material bed comminution for this fine comminution stage.

There is also the possibility for at least a proportion of the ore material, which is at least partially agglomerated, coming out of the material bed comminution to be separated—optionally after previous disagglomeration—into an oversize proportion and into a fine proportion in a screening or separating operation (i.e. with the aid of a screening device or a separating device, such as for example air separator, turbo air separator or the like), the oversize proportion being subjected to a further material bed comminution and the fine proportion being delivered to the method stage following the material bed comminution.

In each case due to the further grinding up of the ore material already coming from a material comminution it is possible to achieve a further optimisation as regards preparation for the subsequent leaching.

In some ore materials the precious metal, e.g. gold, is present in various particle sizes. Since it is basically the case that in order to avoid a reduction in yield exposed gold should be removed from the process as soon as possible, it may be advantageous for the material for grinding to be subjected to further concentration before a further fine comminution. Consequently according to the invention the possibility is provided of subjecting the ore material to material concentration if required after the material bed comminution and before the fine comminution stage. As an alternative thereto, however, it may be advantageous for many ore materials to subject the comminuted ore material to material concentration after the further grinding up in the fine comminution stage and before the possible oxidation treatment. For this any suitable concentration method or any suitable concentration apparatus can be used in order to concentrate the proportion of the ore material containing the precious metal, which can be achieved for example with the aid of flotation, gravity separation or magnetic separation.

Thus the ore material which is comminuted in the material bed comminution, possibly further ground up, possibly oxidised and possibly additionally subjected to a concentration treatment can be optimally prepared according to its specific properties for the method step of leaching and thereby in particular for the container leaching. In this case it is particularly advantageous if the stirring movement is carried out during the container leaching with such an intensity that the entire surface of at least a majority and preferably of all of the ore particles is in contact with the leaching fluid. In this way it is ensured with great reliability that the overwhelming majority of the comminuted ore particles suspended in the leaching fluid do not come into contact with one another during the leaching operation. In this way ores or ore materials which are relatively low in precious metal, both oxidic and non-oxidic, refractory and/or semi-refractory can be prepared or broken up for recovery of the precious metal.

The necessary stirring movement of the leaching fluid and of the ore particles suspended therein within a suitable leaching container can be produced in various ways, for example by a mechanical stirring arrangement, by injection of air, by corresponding pumping arrangements or the like. Any agents which are known per se and are suitable for dissolving the desired precious metal and which contain for example cyanide solutions, bromide solutions, thioureas or the like can be used as leaching fluid or leaching agent.

After the end of the leaching operation the charged leaching fluid is further treated in a manner which is known per se in order to recover or extract the dissolved precious metal.

By means of this method according to the invention, depending upon the physical properties of the starting ore material the following advantages can be achieved:

a) It permits an optimisation of the successive method steps or processing operations, such as the comminution, the material concentration, oxidation treatments, which can include for example roasting, high-pressure oxidation (treatment in autoclaves) and bio-oxidation (using strains of bacteria), as well as the leaching with leaching agent/leaching fluid, in order to increase the recovery of precious metal with reduced operating costs;
b) it facilitates an increased throughput of ore material in further grinding up of the ore material following a material bed comminution, whereby the so-called "bond index" (as material-specific characteristic quantity for calculation of the necessary energy requirement of a ball mill to produce a specific fineness of the mill product) can be lowered;
c) it permits a more effective production of cracks both in the coarse-grained fraction and in the ultra-fine ore particles (approximately 10 to 37 $\mu$m) and little veins of quartz containing precious metal in order to increase the leaching capacity of precious metal;
d) it favours a reduced over-grinding of softer ore particles, so that the formation of a metallurgically disruptive proportion of the finest particles is reduced to a minimum;
e) the consumption of solvent (consumption of leaching fluid) and the residence time are reduced to a minimum, whilst the extraction of precious metal during the flotation concentration is improved;
f) the said oxidation treatments of the comminuted ore material are accelerated during a roasting, an autoclave treatment and a bio-oxidation (using strains of bacteria);
g) the possibility of over-roasting (during the oxidation) is reduced to a minimum;
h) it permits effective treatments of carbonates in order to reduce to a minimum disruptive carbon dioxide and a disruptive build-up of scales or flakes during high-pressure oxidation;
i) and it allows an improved oxidation capacity as well as quicker reaction movements, with increased extraction and reduced leaching time.

THE DRAWINGS

Further details of the invention are apparent from the following examples of the principle which are explained below with the aid of greatly simplified diagrams (basically block diagrams) of the method or apparatus. In these drawings.

DETAILED DESCRIPTION

In all the embodiments of the method according to the invention described with the aid of these block diagrams precious metal, particularly gold, silver and/or platinum, is to be recovered above all from refractory and/or semi-refractory ore material containing precious metal. This ore material can be any naturally occurring ore material (for example copper ores containing gold), residues from ore mining or corresponding industrial residues, which in each case contain precious metal. Refractory and semi-refractory ore material is ore material which is relatively difficult to treat and which cannot be prepared directly and economically with the usual leaching, particularly the usual heap leaching, but requires a corresponding pre-treatment in order to make it accessible to leaching which is known per se, for example with the aid of a cyanide leaching fluid.

Figure 1:
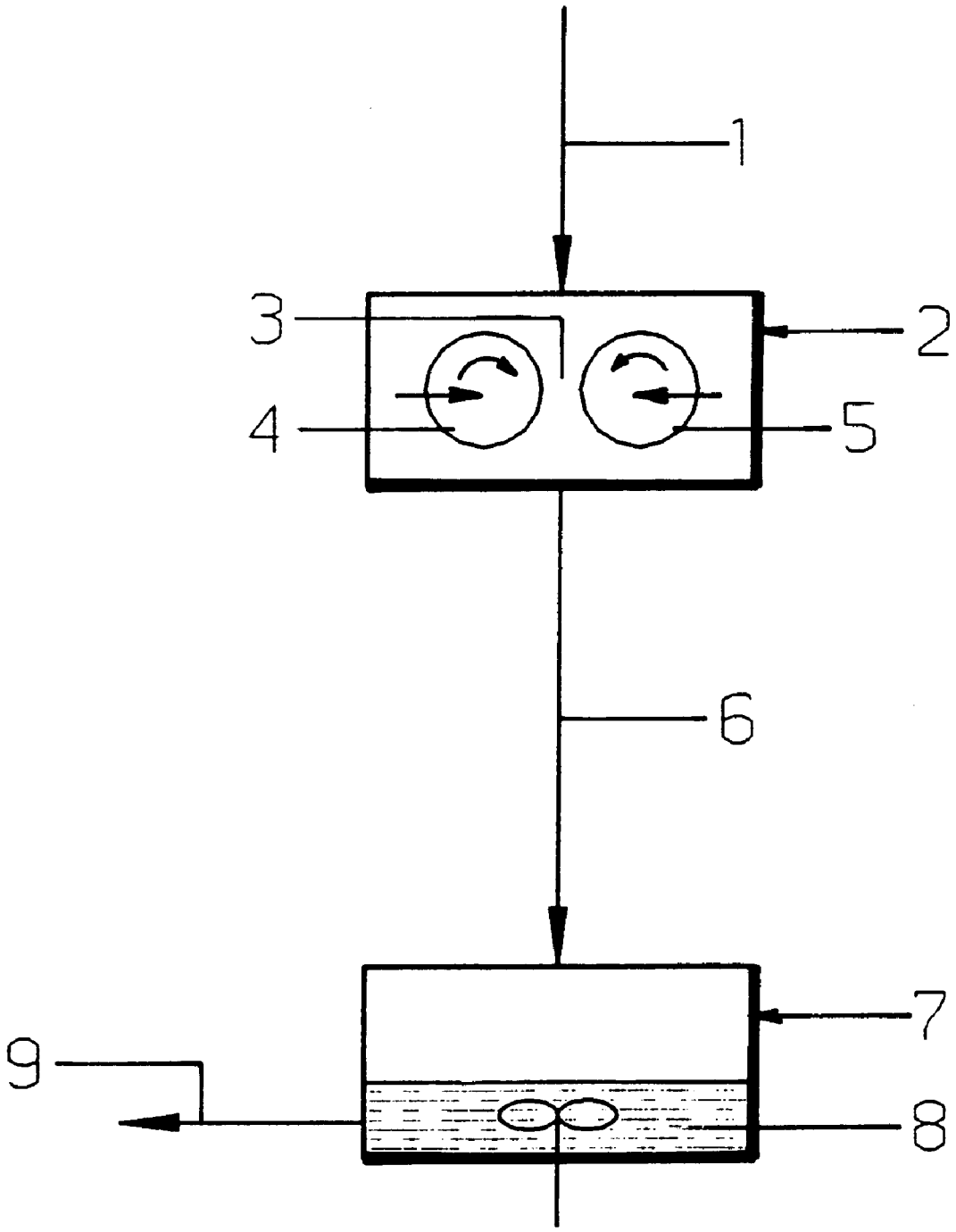
FIG. 1 shows a block diagram of the method according to the invention, in which ore material containing precious metal is subjected to material bed comminution before leaching in a container.

FIG. 1 illustrates a particularly simple embodiment. According to this both oxidic and non-oxidic refractory and/or semi-refractory starting ore material can generally be processed. This starting ore material (arrow 1) is delivered to a material bed roller mill 2 which is known per se in which it is subjected to material bed crushing in the grinding gap 3 between two rollers 4, 5 which are pressed together under a high pressure (>50 MPa), the rollers 4, 5 being driven so that they revolve in opposite directions—according to the arrows indicating the directions of rotation.

The comminuted ore material (arrow 6) coming out of the material bed roller mill 2 is supplied to a leaching container 7 in which a sufficient quantity of leaching fluid 8, for example a corresponding cyanide solution, is located. The comminuted ore material is suspended in this leaching fluid 8, and in this case container leaching of the comminuted ore material is carried out using a stirring movement. In this leaching operation at least most of the comminuted ore particles should be kept out of contact with one another. This stirring movement during the container leaching is particularly advantageously carried out with such an intensity that the entire surface at least of the majority of the ore particles is kept in contact with the leaching fluid. The fluid (arrow 9) which is enriched with dissolved quantities of precious metal after this hydrometallurgical treatment can then be passed on to the usual further treatment in order to extract the desired precious metal.

As has already been explained above, in the material bed comminution in the material bed roller mill 2 the ore material (arrow 1) which is supplied is very optimally comminuted, and simultaneously internal microcracks and microfissures are produced inside the comminuted ore particles, so that in the subsequent container leaching an extremely intensive and efficient leaching of the supplied and comminuted ore material can be take place in the leaching fluid.

Figure 2:
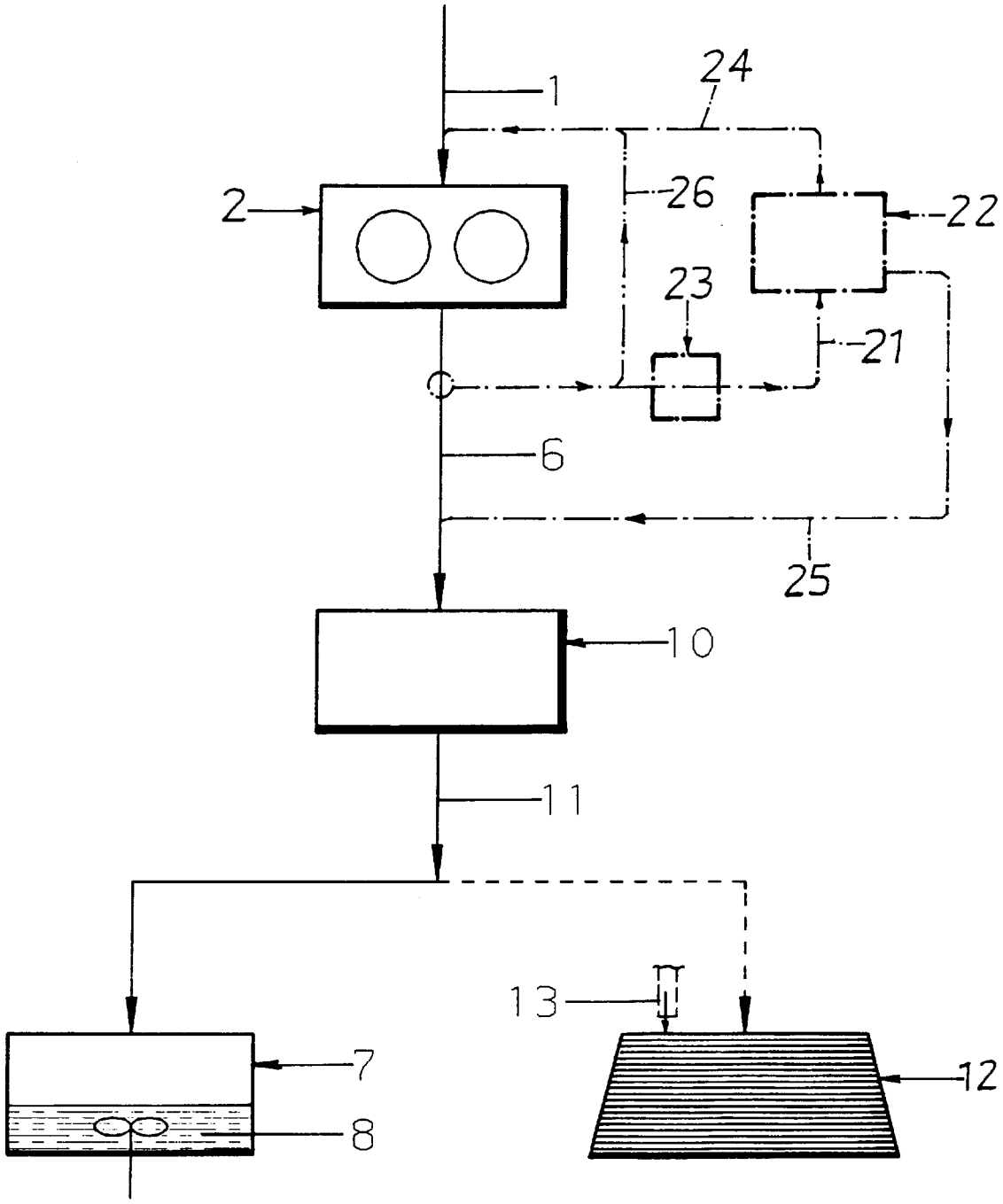
FIG. 2 shows a block diagram of a second embodiment, according to which ore material containing precious metal is subjected to material bed comminution before oxidation and leaching.

The embodiment of the method according to the invention illustrated in FIG. 2 differs from the one described previously with the aid of FIG. 1 principally in that it is designed particularly for the processing of non-oxidic refractory or semi-refractory ore material and that an oxidation treatment takes place between the material bed comminution in the material bed roller mill 2 and the leaching of the comminuted ore material, which is preferably again carried out in a leaching container 7 with leaching fluid 8. Accordingly in this embodiment (FIG. 2) an oxidation arrangement 10, to which the ore material (arrow 6) comminuted in this material bed roller mill 2 is supplied, is arranged after the material bed roller mill 2. This oxidation arrangement 10 can be so constructed that in it roasting, high-pressure oxidation, (autoclave treatment) and/or bio-oxidation (in which oxidation takes place using suitable strains of bacteria) or the like can be carried out in a manner which is known per se in order to oxidise sulphides, carbonaceous components and/or organic rock components. The oxidised ore material (arrow 11) can then—precisely as in the example previously described—preferably be delivered to a container leaching in the leaching container 7.

However, as an alternative—as indicated partially in broken lines in FIG. 2—there is also the possibility of delivering the oxidised ore material (arrow 11) to a heap leaching in a heap 12 on which the comminuted and oxidised ore material can then be leached in a manner which is known per se, leaching fluid (indicated at 13) being uniformly distributed over this heap—as is likewise known. In a further alternative hereto the oxidation of the ore material can also take place on the heap (e.g. by bio-leaching), the actual heap leaching being carried out in the conventional manner after the end of this oxidation.

Figure 3:
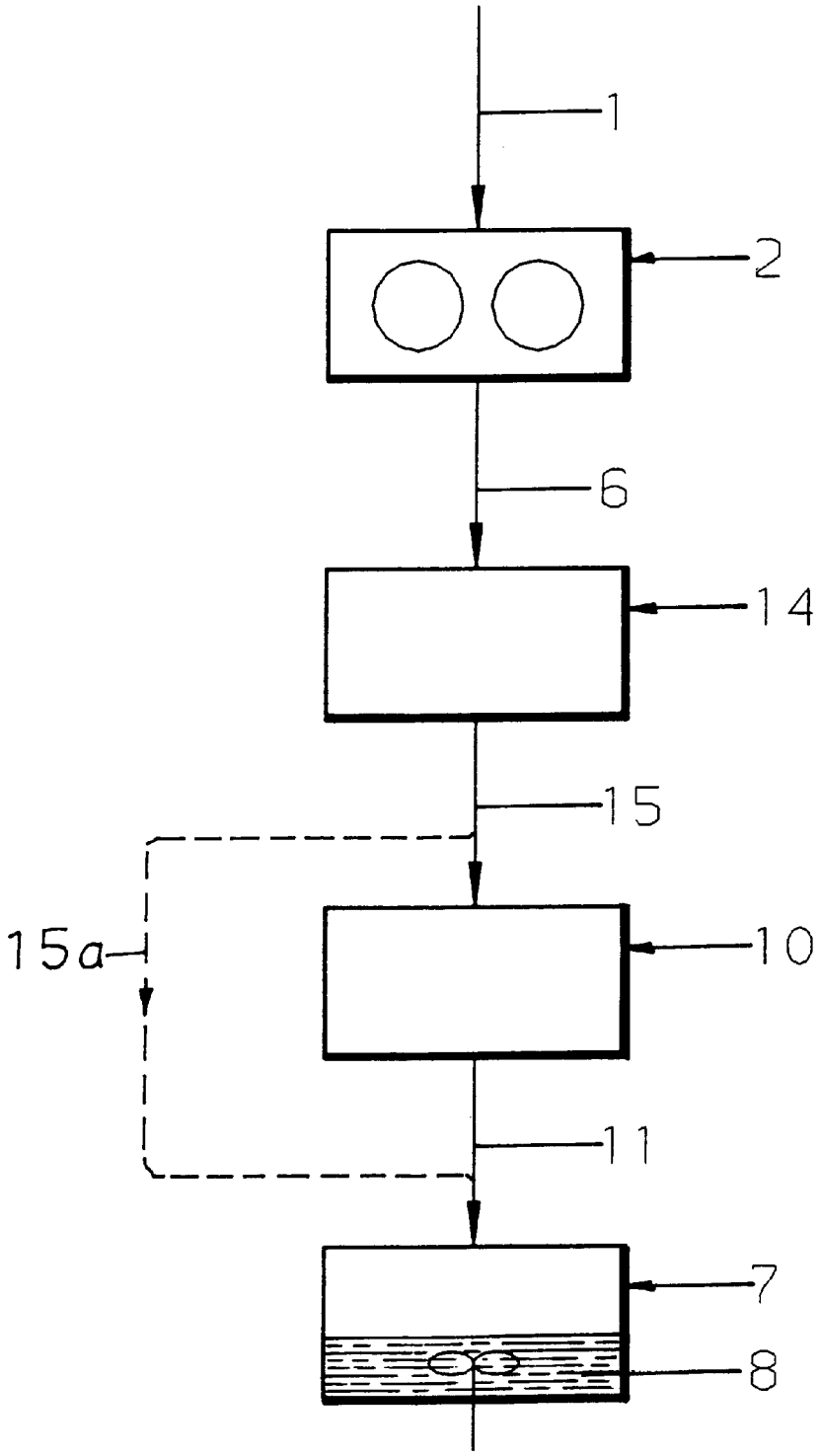
FIG. 3 shows a block diagram of a further embodiment, according to which the ore material containing the precious metal is subjected to material bed comminution before a (second) fine comminution and the oxidation and leaching.

The embodiment according to FIG. 3 is a further development of the method sequence described previously with the aid of FIG. 2. According to this the ore material (arrow 6) comminuted in the material bed in the material bed roller mill 2 is first of all ground up still more in a fine comminution stage 14 before the oxidation treatment in the oxidation arrangement 10. The non-oxidic fine-ground ore material (arrow 15) coming from this fine comminution stage 14 is then—as previously explained with the aid of FIG. 2—subjected to an oxidation treatment and thereupon preferably to a container leaching in the leaching container 7 with leaching fluid 8.

The fine comminution stage 14 can be constructed in any suitable manner. For this an agitator mill or a drum mill, particularly in the form of a ball mill, is particularly suitable, or also an appropriately adapted second material bed roller mill in which a second material bed comminution can then be carried out.

Quite generally there is also the possibility of also preparing and leaching oxidic ore material according to this method sequence. Accordingly in FIG. 3 the possibility is indicated by broken lines of bypassing the oxidation arrangement 10 with a duct 15*a*, i.e. in the case of processing oxidic ore material the oxidation stage can be omitted by deflecting the ore particles from the oxidizing stage.

In place of the additional comminution stage 14 previously explained with the aid of FIG. 3, the alternative shown in FIG. 2 with dash-dot lines can also be provided for a further comminution of the ore material coming out of the material bed roller mill (material bed comminution) 2. According to this, with the aid for example of a deflector 20 or the like at least a proportion of the ore material which is at least partially agglomerated (so-called "scabs") coming out of the material bed comminution (material bed roller mill 2) can be delivered according to the arrow 21 to a suitable screening or separating arrangement 22, and this proportion of the material can optionally be previously disagglomerated in a suitable disagglomerating device 23. The screening or separating device 22 can be either a relatively simple sorting screen or also—which is preferred in many cases—an air separator, particularly an adjustable dynamic air separator of known construction. In this screening or separating device 22 the ore material coming out of the material bed roller mill 2 (arrow 21) is divided into an oversize proportion and a fine proportion, the oversize proportion being returned to the inlet of the material bed roller mill 2 according to the arrow 24 in order to be subjected to renewed material bed comminution there, whilst the fine proportion is passed according to the arrow 25 to the method stage following the material bed comminution, that is to say in the present case to the oxidation arrangement 10, usually with the other, undeflected proportion of ore material 6 coming out of the material bed roller mill 2. Accordingly it is also possible for at least a proportion of the comminuted ore material coming out of the material bed roller mill 2 to be recirculated in closed circuit—by way of the screening or separating arrangement 22—in order to achieve a desired high degree of fineness of the material bed comminution. Furthermore, in the case of this alternative explained with the aid of FIG. 2 there is a further possible variation in so far as according to the line 26 a proportion of the ore material (scabs), which is again appropriately adjustable, coming out of the material bed comminution or material bed roller mill 2 can be returned directly to the inlet of the material bed roller mill 2 in order to increase the fineness of the product to the necessary value.

Figure 4:
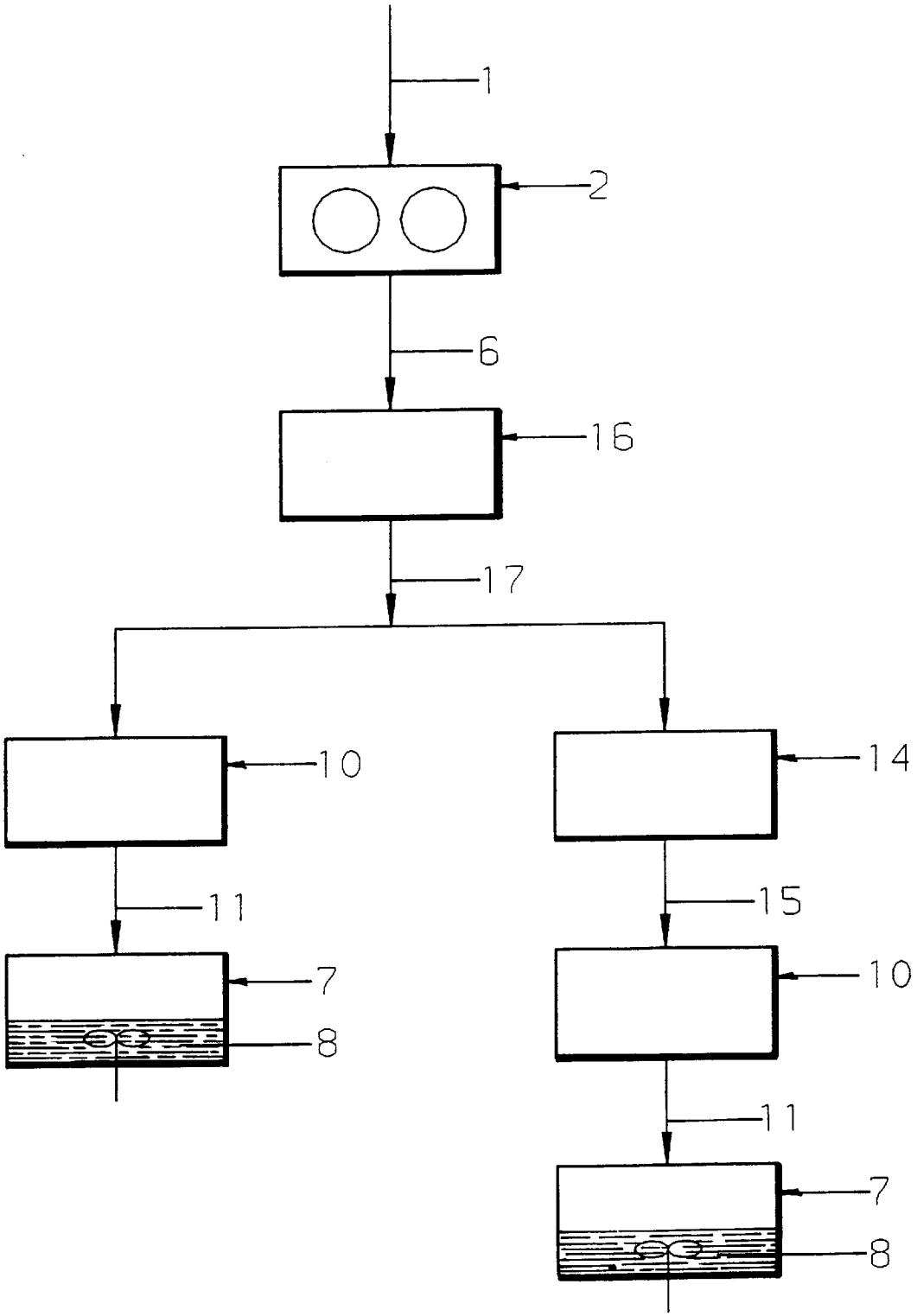
FIG. 4 shows a block diagram for a fourth embodiment, according to which the ore material containing the precious metal is first of all subjected to material bed comminution and then to material concentration, followed as required by an oxidation and container leaching or a second comminution (further grinding up), oxidation and container leaching.

Also in the embodiment according to FIG. 4 the starting ore material (arrow 1) is first of all again subjected to material bed comminution in the material bed roller mill 2. However, the comminuted ore material (arrow 6) resulting from the material bed comminution is then—as a first special feature of this example—subjected to a physical or material concentration in a concentration arrangement 16. This arrangement 16 can be so constructed that in the delivered comminuted ore material (arrow 6) the proportion of the ore material containing precious metal can be concentrated by flotation or gravity separation. The non-oxidic ore material (arrows 17) thus concentrated can then—as a further special feature of this example—as required either be further treated according to the example of FIG. 2 by first of all subjecting it to oxidation treatment in an oxidation arrangement 10 and then to container leaching in the leaching container 7 with leaching fluid 8, or then—in accordance with the example according to FIG. 3—it can first of all be subjected to further grinding up in the fine comminution stage 14, then to oxidation in the oxidation arrangement 10 and again finally to container leaching in the leaching container 7. In this way particularly good possibilities are offered for adaptation to specific properties of the starting ore material, and here too the possibility is again provided of bypassing or omitting the oxidation stage (oxidation arrangement 10) if the ore material is present in oxidic form.

Figure 5:
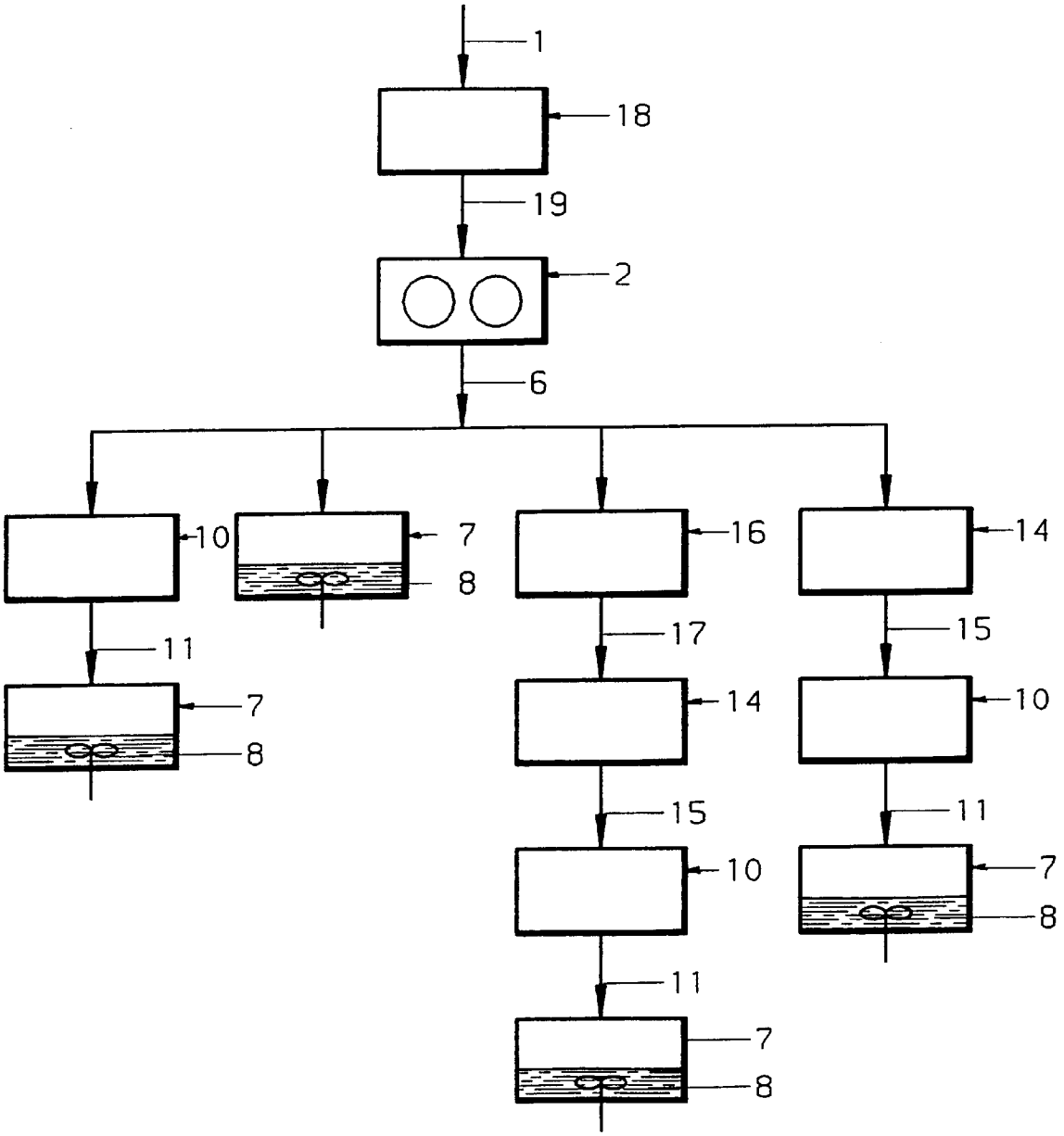
FIG. 5 shows a block diagram of a further embodiment, according to which ore material containing precious metal is first of all pre-comminuted, then further comminuted in material bed comminution, which can be followed alternatively by various further processing steps with final container leaching or combinations thereof.

Finally, FIG. 5 shows an embodiment in which, before it is fed to the material bed roller mill 2, that is to say before the material bed comminution, the starting ore material (arrow 1) is subjected to primary comminution or primary crushing, which can take place in a conventional primary crusher (e.g. roll crusher, jaw crusher or the like) 18. Only the ore material (arrow 19) which has been pre-comminuted in this way and thereby brought to a more uniform starting size of lump is then subjected to the material bed comminution in the material bed roller mill 2. The ore material (arrow 6) resulting from this material bed comminution can then be further treated as required according to the embodiments explained above with the aid of FIGS. 1 to 4. Therefore this means that afterwards there are principally four alternatives for the further treatment of the comminuted ore material (arrow 6):

direct introduction of the comminuted ore material into the leaching container 7 for container leaching;

oxidation of the comminuted ore material (arrow 6) in the oxidation arrangement 10 with subsequent container leaching in the leaching container 7;

first of all further grinding up of the ore material (arrow 6) comminuted in the material bed roller mill 2, in the fine comminution stage 14, then oxidation of the fine ground non-oxidic ore material (arrow 15) in the oxidation arrangement 10 as well as subsequent container leaching of the oxidised ore material (arrow 11) in the leaching container 7; however, if oxidic ore material should be present, an oxidation treatment (in the oxidation arrangement 10) can be omitted;

material concentration of the comminuted ore material (arrow 6) coming from the material bed roller mill 2 in the concentrating arrangement 16, further grinding up of the concentrated non-oxidic ore material (arrow 17) in the fine comminution stage 14, oxidation of the fine ground ore material (arrow 15) in the oxidation arrangement 10 and finally again leaching of the oxidised ore material (arrow 11) in the leaching container 7; if the ore material is present in oxidic form, the oxidation treatment can also be omitted here.

With regard to the preceding examples it should be further emphasised that all the apparatus parts or method steps provided with the same reference numerals have the same features as have been described in detail with the aid of the corresponding examples, so that in each case only one single detailed explanation is sufficient.

Moreover, it should also be emphasised that in the practical implementation of this method according to the invention other combinations than those previously described with the aid of FIGS. 1 to 5 are possible within the scope of the invention.

EXAMPLE

The method according to the invention will be further explained below with the aid of a specific practical example in comparison with a conventional method.

Samples of a non-oxidic semi-refractory ore containing gold were processed.

Two identical samples of this gold-containing ore with a weight of 20 kg were prepared from one single heap of ore which contained approximately 2.013 g (0.071 ounces) of gold per tonne.

The first sample was processed in the following manner using the method according to the invention:

1. The sample was subjected to material bed comminution in a material bed roller mill (from Krupp Polysius) in which the ore was comminuted by being passed through the roller gap between two rollers having a diameter of 300 mm and an axial width of 70 mm which were pressed against one another under high pressure and revolved in opposite directions, and the energy taken up by the mill during the entire comminution process was measured. The grinding of the sample was carried out in one single pass.
2. After this comminution the ore was treated in a rotating tank, which contained approximately 454 g sodium cyanide solution per tonne, at approximately 22° C. for 96 hours. The container had a length of 35 cm and a width of 15 cm and contained 1 kg of ore. The suspension of ore and leaching fluid was stirred during the entire process by a rotary motion of the container.
3. After the ending of the leaching step the gold concentration in the enriched or charged fluid as well as in the solid residues was determined.

The second sample was processed by being comminuted in a conventional comminuting device, then ground in a ball mill and thereafter leached, and this was done in the following way:

1. The sample was comminuted in a conventional roll crusher in order to achieve a comminution size of less than approximately 4 mm, the coarsest proportions of the grinding product corresponding approximately in size to the coarsest proportions of grinding product from the material bed comminution of the first sample.
2. After this roll crushing the comminuted sample was leached, and the quantity of gold extracted was determined in an identical manner to that used in the treatment of the ore sample from the material bed comminution.

A comparison between the results of the samples which were obtained on the one hand by the method according to the invention and on the other hand by the conventional method is set out in the following table.

| | Conventional method | Method according to the invention |
|---|---|---|
| Starting gold content | 2.04 g/t | 2.21 g/t |
| Starting mesh size (starting material before comminution) | 100% < 9.52 mm | 100% < 9.52 mm |
| Particles with microfissures (after comminution) | 14% by vol. | 62% by vol. |
| Total gold recovery | 58.9% | 78.8% |
| Unleached gold in residue distribution with a mesh size above approx. 840 $\mu$m | 83.7% | 47.1% |

The above data clearly show that the method according to the invention greatly improves the effectiveness and the efficiency of the comminution, shortens the time necessary for leaching gold out of the ground ore and considerably increases the recovery of gold or gold values from the ore.

I claim:

1. A method of recovering precious metal from oxidic, refractory, or semi-refractory ore material containing said metal, said method comprising comminuting said ore material in a material bed comminuting zone under pressure sufficient to form particles from said ore material and to form cracks in at least some of said particles, each of said particles having a surface area, each of those particles having cracks therein having its surface area increased by the presence of such cracks; discharging comminuted particles from said comminuting zone; classifying the particles discharged from said comminuting zone into relatively coarse and relatively fine fractions; returning the relatively coarse fraction particles to said comminuting zone for further comminution; oxidizing the relatively fine fraction particles in an oxidizing zone if the ore material is refractory or semi-refractory; diverting the relatively fine fraction particles away from the oxidizing zone if the ore material is oxidic; delivering the relatively fine fraction comminuted particles to a mixing zone containing a leaching fluid capable of dissolving the precious metal, thereby forming in said mixing zone a mixture of said relatively fine fraction particles and said leaching fluid; agitating the mixture at said mixing zone with such intensity as to maintain at least the majority of said relatively fine fraction particles in suspension in said leaching fluid and separated from one another so that said leaching fluid contacts the entire surface area of at least said majority of said relatively fine fraction particles; leaching at least some of the precious metal from said relatively fine traction particles into said leaching fluid in said mixing zone; separating the relatively fine fraction particles from said mixture following leaching of precious metal from said relatively fine fraction particles into said leaching fluid; and extracting the leached metal from said leaching fluid.

2. The method according to claim 1 including subjecting said ore material to primary comminution prior to comminuting said ore material in said comminuting zone.

3. The method according to claim 1 including fine grinding the relatively fine fraction particles following comminuting said ore material in said comminuting zone and prior to delivering the relatively fine fraction particles to said mixing zone.

4. The method according to claim 3 wherein the fine grinding is performed in a mill.

5. The method according to claim 3 wherein the fine grinding is performed in a roller bed mill.

6. The method according to claim 3 wherein the fine grinding is performed in an agitator mill.

7. The method according to claim 3 wherein the fine grinding is performed in a drum mill.

8. The method according to claim 3 wherein the fine grinding is performed in a ball mill.

9. The method according to claim 1 including concentrating those relatively fine fraction particles containing precious metal downstream of said comminuting zone and upstream of said mixing zone so that the relatively fine fraction particles delivered to said mixing zone are those containing precious metal.

10. The method according to any one of the preceding claims wherein the comminuting of said ore material in said comminuting zone is performed in the absence of the addition of binding material.

11. The method according to any one of claims 1–9 wherein the pressure applied in said comminuting zone is greater than 50 MPa.

12. The method according to claim 1 including disagglomerating particles that may have agglomerated in said comminuting zone and prior to delivering the relatively fine fraction particles to said mixing zone, classifying the disagglomerated particles into relatively coarse and relatively fine proportions, and returning the relatively coarse proportion to said comminuting zone for further comminution.

13. The method according to claim 1 including separating agglomerations of comminuted particles from other comminuted particles discharged from said comminuting zone and returning said agglomerations directly to said comminuting zone for further comminution.

14. A method of recovering precious metal from oxidic, refractory, or semi-refractory ore material containing said metal, said method comprising comminuting said ore material in a material bed comminuting zone under pressure sufficient to form particles from said ore material and to form cracks in at least some of said particles, each of said particles having a surface area, each of those particles having cracks therein having its surface area increased by the presence of such cracks; discharging comminuted particles from said comminuting zone; classifying in a classifying zone at least a portion of the particles discharged from said comminuting zone into relatively coarse and relatively fine fractions; returning the relatively coarse fraction particles to said comminuting zone for further comminution; oxidizing the relatively fine fraction particles in an oxidizing zone if the ore material is refractory or semi-refractory; diverting the relatively fine fraction particles away from the oxidizing zone if the ore material is oxidic; delivering the relatively fine fraction comminuted particles to a mixing zone containing a leaching fluid capable of dissolving the precious metal, thereby forming in said mixing zone a mixture of said relatively fine fraction particles and said leaching fluid; agitating the mixture at said mixing zone with such intensity as to maintain at least the majority of said relatively fine fraction particles in suspension in said leaching fluid and separated from one another so that said leaching fluid contacts the entire surface area of at least said majority of said relatively fine fraction particles; leaching at least some of the precious metal from said relatively fine fraction particles into said leaching fluid in said mixing zone; separating the relatively fine fraction particles from said mixture following leaching of precious metal from said relatively fine fraction particles into said leaching fluid; and extracting the leached metal from said leaching fluid.

15. The method according to claim 14 including returning the relatively coarse fraction particles following classifying of the particles discharged from said comminuting zone directly from said classifying zone to said comminuting zone.

* * * * *

UNITED STATES PATENT AND TRADEMARK OFFICE

Certiicate

Patent No. 5,985,221

Patented: November 16, 1999

On petition requesting issuance of a certificate for correction of inventorship pursuant to 35 U.S.C. 256, it has been found that the above identified patent, through error and without any deceptive intent, improperly sets forth the inventorship.

Accordingly, it is hereby certified that the correct inventorship of this patent is: Johann Knecht, Wadersloh, Germany and Wolfgang Baum, Corapolis, Pennsylvania.

Signed and Sealed this Twenty-Eighth Day of November, 2000.

STEVEN P. GRIFFIN
*Supervisory Patent Examiner*
Art Unit 1754